United States Patent [19]

Saito

[11] Patent Number: 4,567,454

[45] Date of Patent: Jan. 28, 1986

[54] RESONATOR DEVICE

[75] Inventor: Koji Saito, Takatsuki, Japan

[73] Assignee: Murata Manufacturing Co., Ltd., Kyoto, Japan

[21] Appl. No.: 604,494

[22] Filed: Apr. 27, 1984

[30] Foreign Application Priority Data

May 2, 1983 [JP] Japan ..... 58-66686[U]

[51] Int. Cl.[4] ..... H01P 1/205; H01P 7/04

[52] U.S. Cl. ..... 333/206; 333/222; 333/245

[58] Field of Search ..... 333/202, 206, 207, 222, 333/223, 245, 181–185; 29/600, 601

[56] References Cited

U.S. PATENT DOCUMENTS

| | | | |
|---|---|---|---|
| 3,275,954 | 9/1966 | Coda et al. | 333/183 |
| 3,753,168 | 8/1973 | Schor | 333/185 |
| 4,464,640 | 8/1964 | Nishikawa et al. | 333/206 X |

*Primary Examiner*—Marvin L. Nussbaum

*Attorney, Agent, or Firm*—Wenderoth, Lind & Ponack

[57] ABSTRACT

A resonator device including an electrically conductive mounting member, at least one dielectric coaxial resonator mounted on the mounting member and an electrically conductive elastic member for securing the dielectric coaxial resonator to the mounting member. In the resonator device, the dielectric coaxial resonator is secured and electrically connected to the mounting member through elasticity of the elastic member.

11 Claims, 10 Drawing Figures

RESONATOR DEVICE

BACKGROUND OF THE INVENTION

The present invention generally relates to a dielectric coaxial resonator including a cylindrical dielectric member and more particularly, to a resonator device equipped with the dielectric coaxial resonator and a mounting member having the dielectric coaxial resonator secured thereto.

Conventionally, in dielectric coaxial resonators, it has been, for example, so arranged as shown in FIG. 1 that a $\frac{1}{4}$ wavelength TEM-mode (transverse electro-magnetic mode) coaxial resonator 1 generally includes an inner conductor 2, an outer conductor 3 and a cylindrical dielectric member 4 made of, for example, ceramic dielectric material of titanium oxide group such that the dielectric member 4 is disposed between the inner conductor 2 and the outer conductor 3. More specifically, the dielectric member 4 is formed with a central bore so as to be of annular shape having a large wall thickness. The inner conductor 2 and the outer conductor 3 are, respectively, formed on inner and outer cylindrical surfaces of the dielectric member 4 by baking thereonto a material, e.g. silver paste, having superior high frequency electrical conductivity and also an excellent property of closely adhering to the dielectric member 4. The resonator 1 has an electrically open end 7 and a short-circuiting end 10 which are, respectively, disposed at opposite ends of the dielectric member 4. Meanwhile, the inner conductor 2 has a bore formed therein and a central rod 5 made of, for example, ceramic material and having a length larger than that of the dielectric member 4 is fitted, for securing thereof, into the bore of the inner conductor 2 such that an end portion 6 of the central rod 5 projects out of the electrically open end 7 of the resonator 1. Furthermore, an electrode film 8 extending from the inner conductor 2 is coated on the end portion 6, while an electrode 9 for short-circuiting the inner conductor 2 and the outer conductor 3 is provided on the short-circuiting end 10 of the resonator 1.

Referring to FIG. 2, there is shown another prior art resonator 11 which does not employ the central rod 5 of the resonator 1. The resonator 11 includes a terminal electrode 12 of arbitrary shape and chip type capacitors 21 and 22. The terminal electrode 12 is fitted into the bore defined by the inner conductor 2 so as to be secured thereto by electrically conductive adhesive such that the terminal electrode 12 is electrically connected to the inner conductor 2. Meanwhile, the chip type capacitors 21 and 22 are used for capacitive coupling of the resonator 11 with other components such as other resonators, connectors, etc. Namely, one end of the terminal electrode 12 is formed into a proper shape so as to be electrically connected to one electrode 23 of the capacitor 21 and one electrode 24 of the capacitor 22. Meanwhile, one end of the lead wire 27 is connected to the other electrode 25 of the capacitor 21 and one end of a lead wire 28 is connected to the other electrode 26 of the capacitor 22 such that the other end of the lead wire 27 and the other end of the lead wire 28 are connected to other resonators, connectors, etc.

Referring to FIG. 3, there is shown a prior art electrical filter 30 employing a plurality of the resonators 11 of FIG. 2. The electrical filter 30 includes a first casing portion 40 having a shape of rectangular parallelopiped. The first casing portion 40 is made of electrically conductive material, for example, duralumin and has grooves 51, 52, 53 and 54 of semicircular cross section formed therein, in this order from one end of the first casing portion 40 to the other end of the first casing portion 40, in spaced and parallel relation to each other at intervals of a predetermined distance. Meanwhile, slots 61, 62 and 63 of semicircular cross section are, respectively, formed between the grooves 51 and 52, between the grooves 52 and 53 and between the grooves 53 and 54. Furthermore, slots 71 and 72 are, respectively, formed between the one end of the first casing portion 40 and the groove 51 and between the groove 54 and the other end of the first casing portion 40. It is to be noted here that the slots 71, 61, 62, 63 and 72 are formed in alignment with each other in this order from the one end of the first casing portion 40 to the other end of the first casing portion 40.

The electrical filter 30 further includes a second casing portion 41 of the same construction as that of the first casing portion 40. Namely, as shown in FIG. 4, a rectangular casing of the electrical filter 30 is of a two-piece construction constituted by the first casing portion 40 and the second casing portion 41. A half of the resonator 11 is fitted into each of the grooves 51, 52, 53 and 54 of the first casing portion 40 and the outer conductor 3 of the resonator 11 is secured to the first casing portion 40 by electrically conductive adhesive or screws so as to be electrically connected to the first casing portion 40. An input coaxial connector 81 and an output coaxial connector 82, whose half portions are, respectively, fitted into the slots 71 and 72, are fixed to the first and second casing portions 40 and 41 by a known method. A central terminal of the input coaxial connector 81 is connected, through a lead wire 91, to the capacitor 21 of the resonator 11 disposed in the groove 51. The capacitor 22 of the resonator 11 disposed in the groove 51 is connected, via a lead wire 92 extending through the slot 61, to the capacitor 21 of the resonator 11 disposed in the groove 52. Then, the capacitor 22 of the resonator 11 disposed in the groove 52 is connected, by way of a lead wire 93 extending through the slot 62, to the capacitor 21 of the resonator 11 disposed in the groove 53. Furthermore, the capacitor 22 of the resonator 11 disposed in the groove 53 is connected, via a lead wire 94 extending through the slot 63, to the capacitor 21 of the resonator 11 disposed in the groove 54. Moreover, the capacitor 22 of the resonator 11 disposed in the groove 54 is connected, through a lead wire 95, to a central terminal of the output coaxial connector 82.

As is clear from the above described construction of the electrical filter 30, it has been so arranged that the resonator 11 is secured to the first and second casing portions 40 and 41 by bonding thereto the outer conductor 3 by the use of electrically conductive adhesive 100 as shown in FIG. 5 or by inserting a copper net 110 impregnated with adhesive between the outer conductor 3 and the first and second casing portions 40 and 41 as shown in FIG. 6.

However, the known electrical filter 30 including the resonators 11 secured to the first and second casing portions 40 and 41 as described above has such a disadvantage that, since a linear expansion coefficient of the resonator 11 is vastly different from that of the first and second casing portions 40 and 41 or that of the adhesive, the outer conductors 3 of the resonators 11 are readily separated from the resonators 11 when the known electrical filter 30 is subjected to sharp change in temperature.

Furthermore, the known electrical filter 30 has such inconveniences that operations for securing the resonators 11 to the first and second casings 40 and 41 are troublesome and a long time period is required for curing the adhesive, thus resulting in an increased production cost.

SUMMARY OF THE INVENTION

Accordingly, an essential object of the present invention is to provide an improved resonator device including a mounting member, at least one dielectric coaxial resonator and an elastic member means, in which the dielectric coaxial resonator is easily secured to the mounting member through only elasticity of the elastic member means such that an outer conductor of the dielectric coaxial resonator is prevented from being separated from the dielectric coaxial resonator, with substantial elimination of the disadvantages inherent in conventional resonator devices of this kind.

Another important object of the present invention is to provide an improved resonator device of the above described type which is simple in structure, highly reliable in actual use and suitable for mass production at low cost.

Still another object of the present invention is to provide an improved resonator device of the above described type in which the dielectric coaxial resonator is secured to the mounting member so as to be electrically stably connected to the mounting member.

In accomplishing these and other objects according to one preferred embodiment of the present invention, there is provided an improved resonator device comprising: an electrically conductive mounting member; at least one dielectric coaxial resonator mounted on said mounting member; said dielectric coaxial resonator including a dielectric member formed with a bore, an inner conductor member formed on a periphery of said bore, and an outer conductor member formed on an outer periphery of said dielectric member; and an elastic member means for securing said dielectric coaxial resonator to said mounting member, whereby said dielectric coaxial resonator is secured to said mounting member through only elasticity of said elastic member means.

In accordance with the present invention, since nonuniformity among dimensional changes of the resonator, the mounting member, etc. is absorbed by the elastic member means even if the resonator device is subjected to sharp change in temperature, the outer conductor of the resonator is positively prevented from being separated from the resonator.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

As one example of a resonator device, an electrical filter S according to one preferred embodiment of the present invention will be described with reference to FIGS. 7 to 9, hereinbelow.

Figure 1:
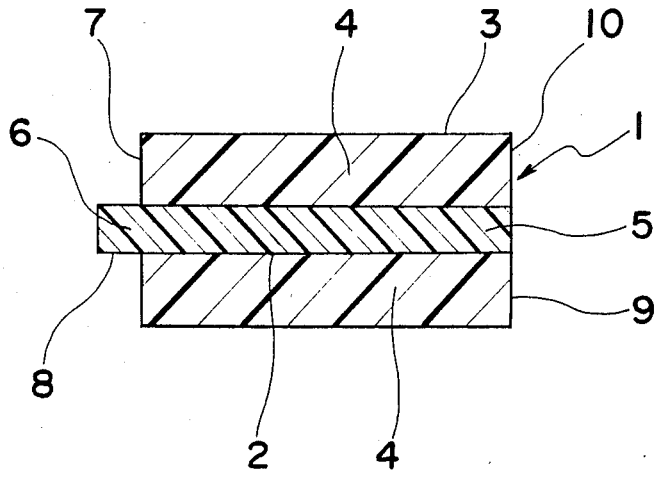
Fig. 1 PRIOR ART
FIG. 1 is a cross-sectional view of one prior art $\frac{1}{4}$ wavelength TEM-mode coaxial resonator (already referred to)
Figure 2:
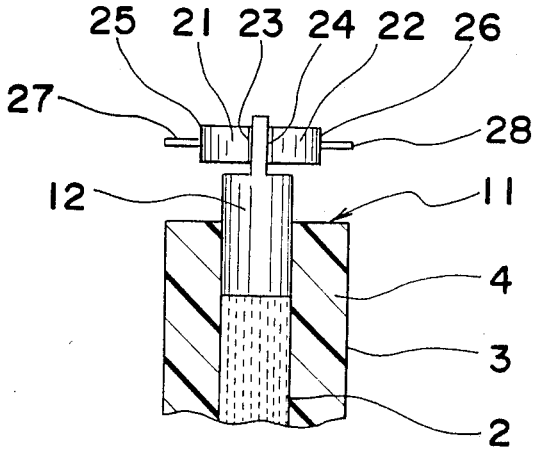
Fig. 2 PRIOR ART
FIG. 2 is a fragmentary cross-sectional view of another prior art $\frac{1}{4}$ wavelength TEM-mode coaxial resonator (already referred to)
Figure 3:
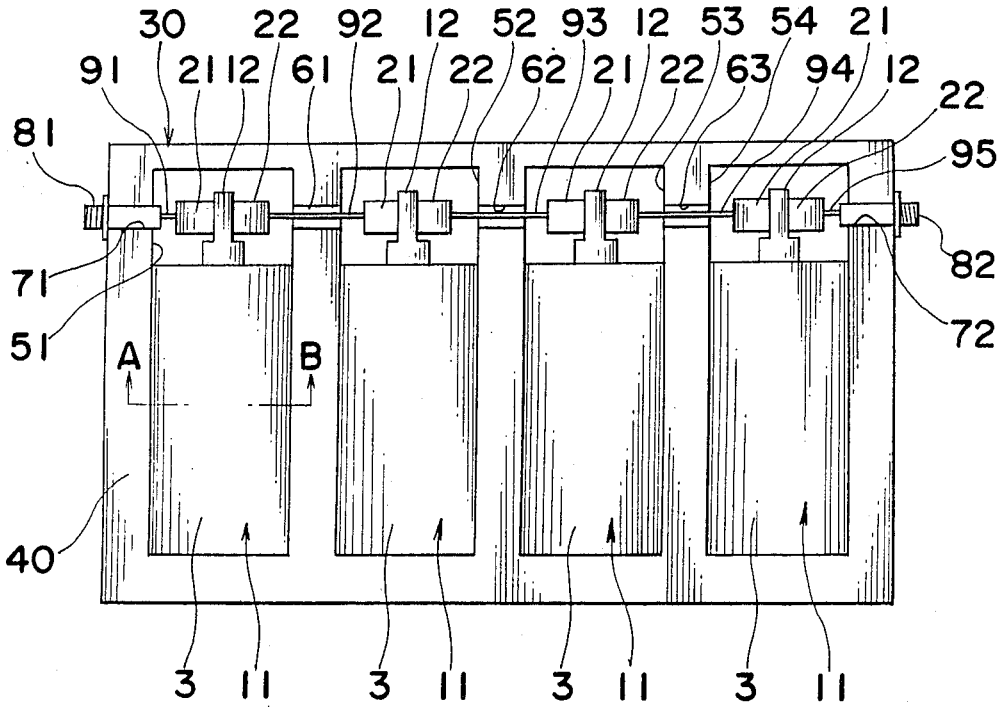
Fig. 3 PRIOR ART
FIG. 3 is a view explanatory of an inner construction of a prior art electrical filter (already referred to)
Figure 4:
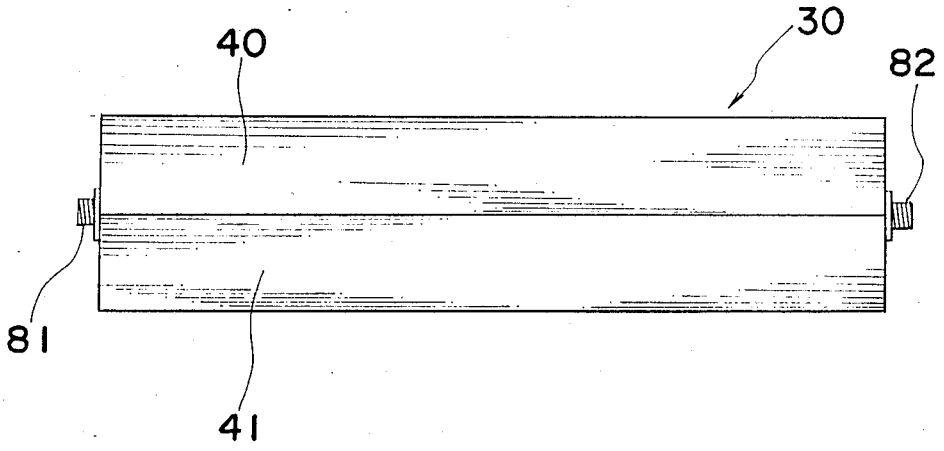
Fig. 4 PRIOR ART
FIG. 4 is a top plan view of the prior art electrical filter of FIG. 3 (already referred to)
Figure 5:
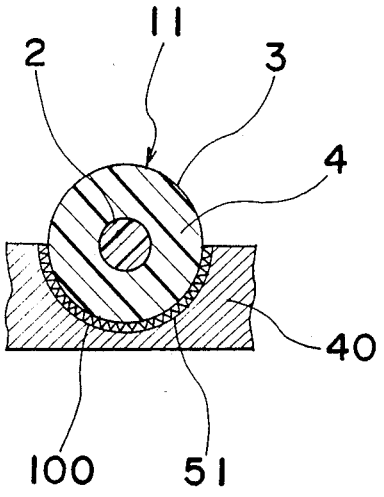
Fig. 5 PRIOR ART
FIGS. 5 and 6 are cross-sectional views taken along the line A–B in FIG. 3 (already referred to)
Figure 6:
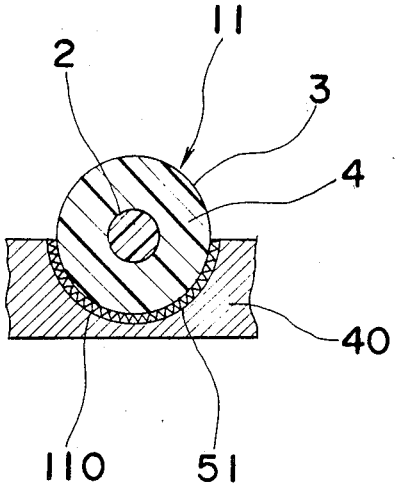
Fig. 6 PRIOR ART
Figure 7:
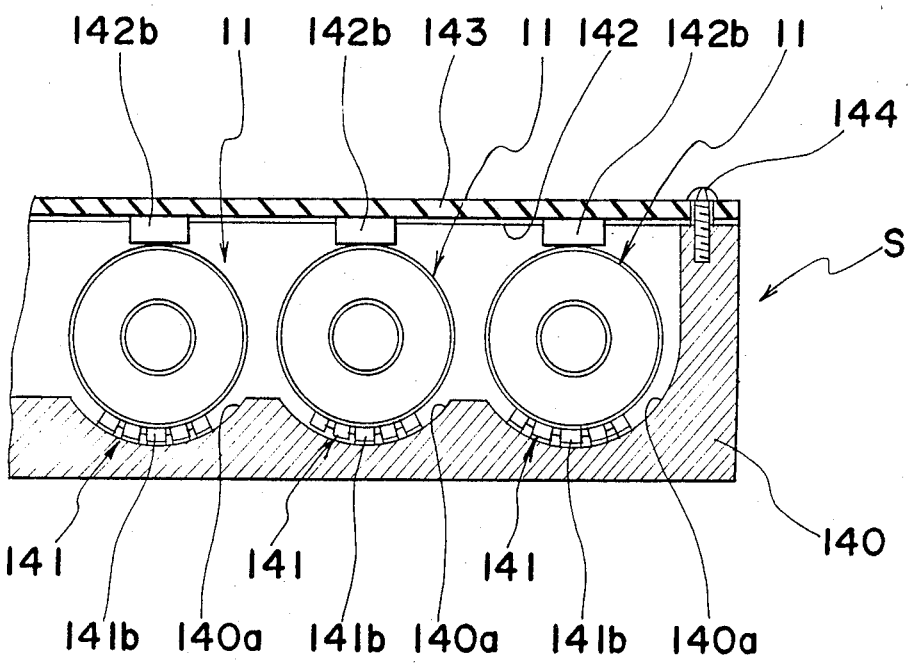
FIG. 7 is a fragmentary cross-sectional view of an electrical filter according to one preferred embodiment of the present invention.

Referring to FIG. 7, the electrical filter S includes a plurality of the $\frac{1}{4}$ wavelength TEM-mode coaxial resonators 11 already referred to in FIG. 2, a casing 140 acting as a mounting member for the resonators 11, a plurality of lower grounding plates 141 one provided for each of the resonators 11, an upper grounding plate 142 and a retainer plate 143. The casing 140 and the retainer plate 143 are made of metal or plastics plated with metal. The casing 140 is formed with a plurality of grooves 140*a* of arcuate cross section having a curvature radius slightly larger than a half of an outside diameter of the resonator 11. The grooves 140*a* are formed on an inner surface of a bottom wall of the casing 140 in spaced and parallel relation to each other at intervals of a predetermined distance.

Figure 8:
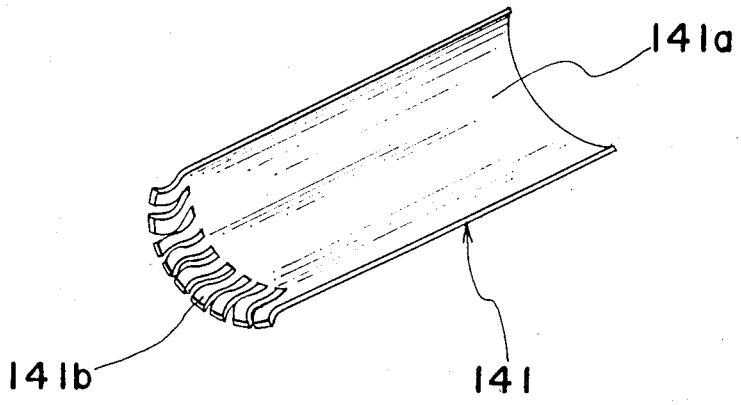
FIG. 8 is a perspective view of a lower grounding plate employed in the electrical filter of FIG. 7.

As shown in FIG. 8, the lower grounding plate 141 is obtained by bending a rectangular metal sheet 141*a* into an arcuate shape along the groove 140*a* of the casing 140 and has a number of arcuate spring pieces 141*b* raised from one end thereof. Meanwhile, although each of the lower grounding plates 141 is provided for a separate one of the resonators 11 as described above, a plurality of the lower grounding plates 141 can be replaced by a single lower grounding plate member obtained by integrally forming the lower grounding plates 141 with each other. Furthermore, it can be also so arranged that, without forming the lower grounding plate 141 into an arcuate shape beforehand, a lower grounding plate of flat shape is utilized so as to be bent into an arcuate shape by pressing the resonator 11 onto the lower grounding plate of flat shape placed on the groove 140*a*.

Figure 9:
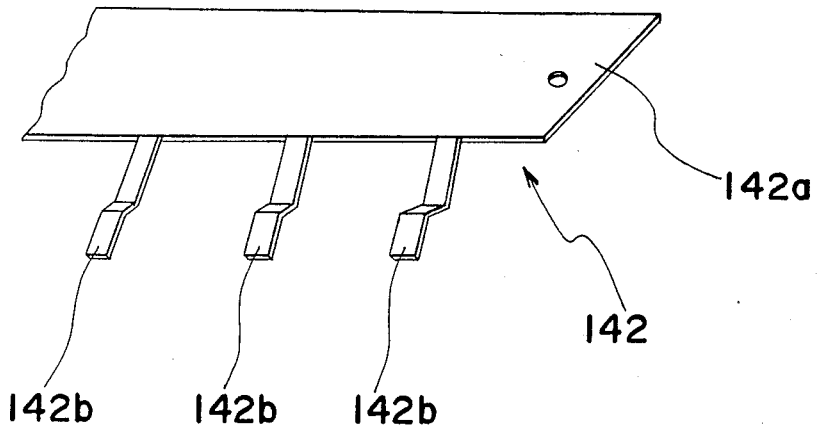
FIG. 9 is a fragmentary perspective view of an upper grounding plate employed in the electrical filter of FIG. 7.

Meanwhile, as shown in FIG. 9, the upper grounding plate 142 is obtained by blanking an elastic metal plate such that a plurality of plate springs 142*b* project, at intervals of the predetermined distance given for the grooves 140*a*, out of one side edge of a support portion 142*a* having a substantially uniform width.

The lower grounding plates 141 are, respectively, placed on the grooves 140*a* of the casing 140 and then, the resonators 11 are, respectively, placed on the lower grounding plates 141. Thereafter, the upper grounding plate 142 is placed on the resonators 11. The retainer plate 143 is further placed on the upper grounding plate 142 so as to be attached to the casing 140 by screws 144.

It should be noted that the spring pieces 141*b* of the lower grounding plates 141 and the plate springs 142*b* of the upper grounding plate 142 are brought into pressing contact with portions of the outer conductors 3, which portions are disposed adjacent to the electrically open ends of the resonators 11. It should be further noted that the spring pieces 141*b* of the lower grounding plates 141 are also brought into pressing contact with the grooves 140*a* of the casing 140. Meanwhile, the upper grounding plate 142 is interposed between the retainer plate 143 and the casing 140 so as to be electrically connected to the casing 140. Accordingly, the resonators 11 are short-circuited, in close vicinity to the electrically open ends of the resonators 11, to the casing 140 through the lower grounding plates 141 and the upper grounding plate 142.

By the above described arrangement of the electrical filter S, even if the resonators 11, the casing 140, etc. are subjected to dimensional changes resulting from thermal expansion and the like due to change in temperature, etc., nonuniformity among the dimensional changes of the resonators 11, the casing 140, etc. is absorbed by the spring pieces 141*b* of the lower grounding plates 141 and the plate springs 142*b* of the upper grounding plate 142, whereby the outer conductors 3 of the resonators 11 are prevented from being separated from the resonators 11.

Meanwhile, by simply placing the upper grounding plate 142 and the lower grounding plates 141 on and under the resonators 11, respectively in the casing 140 and then, securing to the casing 140 by the screws 144 the retainer plate 143 placed on the upper grounding plate 142, the outer conductors 3 of the resonators 11 can be electrically connected to the casing 140 with much ease.

Furthermore, since two portions of each of the plate springs 142*b* of the upper grounding plate 142 are brought into pressing contact with each of the resonators 11, the resonators 11 are least subjected to pitching (vertical vibration). Although such a construction of the plate springs 142*b* is desirable for reducing external dimensions of the electrical filter S, portions of each of the plate springs 142*b*, which are brought into pressing contact with each of the resonators 11, are not limited, in number, to two.

Figure 10:
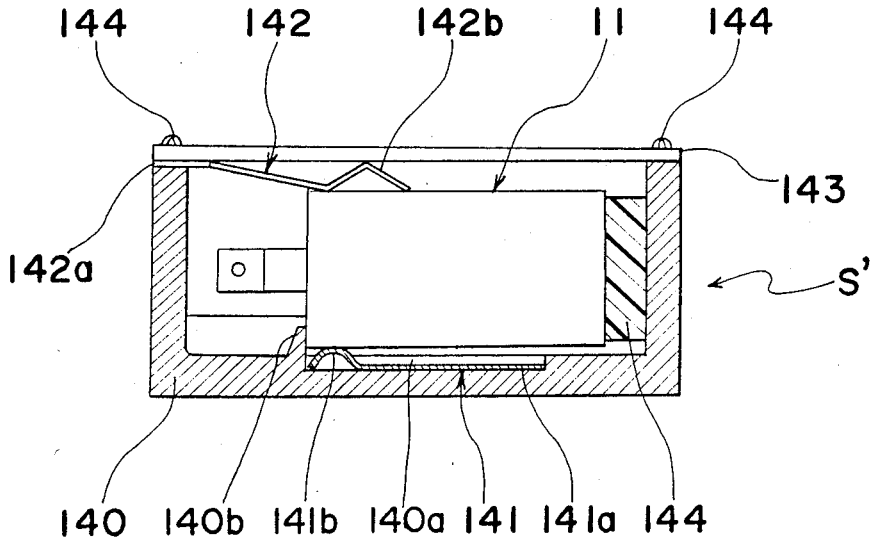
FIG. 10 is a view similar to FIG. 7, particularly showing a modification thereof.

Referring further to FIG. 10, there is shown an electrical filter S′ which is a modification of the electrical filter S. In the modified electrical filter S′, in order to prevent axial displacement of the resonators 11, a stopper projection 140*b* is formed in each of the grooves 140*a* so as to come into contact with the electrically open end of each of the resonators 11 and an elastic piece 144 is interposed between the short-circuiting end of each of the resonators 11 and the casing 140 such that each of the resonators 11 is secured between the stopper projection 140*b* and the elastic piece 144.

Meanwhile, in the electrical filters S and S′, it can be also so arranged that the retainer plate 143 is replaced by a plate made of highly electrically conductive metal and springs (not shown) similar to the plate springs 142*b* of the upper grounding plate 142 are attached to or integrally formed with the plate in place of the upper grounding plate 142. Furthermore, it can be also so arranged that the upper grounding plate 142 is replaced by a sheet made of highly electrically conductive material and the retainer plate 143 is made of elastic material such that the sheet is brought into pressing contact with the outer conductors 3 of the resonators 11.

Furthermore, the present invention may be also applicable to a ½ wavelength dielectric coaxial resonator having a dielectric member whose opposite ends are electrically open. In this case, it is so arranged that the spring pieces 141*b* of the lower grounding plates 141 and the plate springs 142*b* of the upper grounding plate 142 are brought into pressing contact with the electrically open ends of the resonators.

Moreover, it can be also so arranged that the lower grounding plates 141 are eliminated from the electrical filters S and S′.

It should be also noted that the present invention is not limited in its application only to the single cylindrical dielectric coaxial resonator as described so far, but may be readily applied to arrangements in which a plurality of dielectric coaxial resonators are formed in one dielectric block.

As is clear from the foregoing description, in accordance with the present invention, since the dielectric coaxial resonators are secured to the mounting member through only elasticity of the elastic members, nonuniformity among dimensional changes of the dielectric coaxial resonators and the mounting member due to thermal expansion, etc. is absorbed by the elastic members, so that the outer conductors of the dielectric coaxial resonators can be prevented from being separated from the dielectric coaxial resonators.

Furthermore, in accordance with the present invention, since it becomes unnecessary to perform operations such as soldering so as to electrically connect the outer conductors of the dielectric coaxial resonators to the casing, the dielectric coaxial resonators can be secured to the casing with much ease and replacement of defective dielectric coaxial resonators among a plurality of the dielectric coaxial resonators accommodated in the casing can be performed easily.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A resonator device, comprising;

an electrically conductive mounting member;

at least one axially extending dielectric coaxial resonator having an electrically open axial end and an opposite end axially opposite said electrically open end, including a dielectric member formed with an axially extending bore, an inner conductor member formed on a radial periphery of said bore, and an outer conductor member formed on a radially outer periphery of said dielectric member;

means, including an elastic member located between said dielectric coaxial resonator and said mounting member, for securing said dielectric coaxial resonator to said mounting member only elastically, through said elastic member and electrically pressing said dielectric coaxial resonator into electrical contact with said mounting member; and an elastic piece interposed between said opposite end of said dielectric coaxial resonator and said mounting member;

said mounting member being formed with a stopper projection contacting said electrically open end of said dielectric coaxial resonator;

said dielectric coaxial resonator being secured between said elastic piece and said stopper projection so as to be prevented from being displaced axially.

2. A resonator device as claimed in claim 1, wherein said securing means includes a first elastic element disposed on the radial periphery of said dielectric coaxial resonator so as to be brought into pressing contact with said dielectric coaxial resonator.

3. A resonator device as claimed in claim 1, wherein said securing means includes a first elastic member disposed on the radial periphery of said dielectric coaxial resonator and a second elastic member interposed between said mounting member and said dielectric coaxial resonator and diametrically opposed to said first elastic member with respect to said dielectric coaxial resonator so as to interpose said dielectric coaxial resonator between said first elastic member and said second elastic member such that said first elastic member and said second elastic member are brought into pressing contact with said dielectric coaxial resonator.

4. A resonator device as claimed in claim 1, wherein said securing means is brought into pressing contact, in close proximity to said electrically open end of said dielectric coaxial resonator, with said dielectric coaxial resonator.

5. A resonator device as in claim 4, wherein said elastic member is electrically conductive and electrically connects said dielectric coaxial resonator and said mounting member.

6. A resonator device as claimed in claim 1, wherein said mounting member is formed with a groove for receiving said dielectric coaxial resonator.

7. A resonator device as claimed in claim 1, wherein said dielectric coaxial resonator is a $\frac{1}{4}$ wavelength transverse electro-magnetic mode coaxial resonator.

8. A resonator device as claimed in claim 1, wherein said dielectric coaxial resonator is a $\frac{1}{2}$ wavelength transverse electro-magnetic mode coaxial resonator.

9. A resonator device as claimed in claim 1, which is an electrical filter.

10. A resonator device as in claim 1, wherein said elastic member is electrically conductive and electrically connects said dielectric coaxial resonator and said mounting member.

11. A resonator device as in claim 1, wherein said stopper projection is integrally formed on said mounting member, said elastic piece being spaced from said elastic member.

* * * * *